US006087775A

United States Patent [19]

Levinson et al.

[11] Patent Number: 6,087,775

[45] Date of Patent: Jul. 11, 2000

[54] EXTERIOR SHROUD LAMP

[75] Inventors: Lionel Monty Levinson; John Fredrick Ackerman, both of Niskayuna, N.Y.; John Martin Davenport, Lindhurst, Ohio; Laurence Bigio, Niskayuna, N.Y.

[73] Assignee: General Electric Company, Schenectady, N.Y.

[21] Appl. No.: 09/015,227

[22] Filed: Jan. 29, 1998

[51] Int. Cl.[7] ..... H01J 1/32

[52] U.S. Cl. ..... 313/635; 313/25; 313/27; 313/45; 313/47; 313/569; 313/573; 579/580; 579/112; 579/113

[58] Field of Search ..... 313/17, 25, 27, 313/45, 47, 569, 573, 578, 579, 580, 113, 112, 634, 635

[56] References Cited

U.S. PATENT DOCUMENTS

| | | | |
|---|---|---|---|
| 4,517,491 | 5/1985 | Otto et al. | 313/579 |
| 4,535,269 | 8/1985 | Tschetter et al. | 313/579 |
| 4,572,991 | 2/1986 | Cote | 315/240 |
| 4,591,752 | 5/1986 | Thouret et al. | 313/25 |
| 4,634,919 | 1/1987 | Yuge et al. | 313/580 X |
| 4,652,789 | 3/1987 | Kawakatsu et al. | 313/112 |
| 5,221,876 | 6/1993 | Bergman et al. | 315/82 |
| 5,388,034 | 2/1995 | Allen et al. | 362/61 |
| 5,506,471 | 4/1996 | Kosmatke et al. | 313/112 X |
| 5,610,469 | 3/1997 | Bergman et al. | 313/25 |

FOREIGN PATENT DOCUMENTS 8264163 10/1996 Japan .

*Primary Examiner*—Ashok Patel
*Attorney, Agent, or Firm*—Ernest G. Cusick; Noreen C. Johnson

[57] ABSTRACT

A lamp assembly comprises a incandescent lamp capable of generating light. The incandescent lamp comprises a incandescent lamp tube and at least one filament. The assembly also comprises a shroud separate from the incandescent lamp and mounted in communication with the lamp tube on an exterior of the incandescent lamp tube. The shroud also comprises a coating disposed on the reflecting section of the shroud for reflecting energy having predetermined wavelengths emitted by the incandescent lamp. The shroud comprises a reflecting section disposed about the incandescent lamp tube, where the geometry of the shroud generally conforms to the geometry of the at least one filament of the lamp, to reflect energy having predetermined wavelengths back substantially toward the incandescent lamp and focusing the reflected energy generally at the at least one filament of the incandescent lamp so as to increase the output from the assembly.

46 Claims, 5 Drawing Sheets

EXTERIOR SHROUD LAMP

FIELD OF THE INVENTION

The invention is related to incandescent lamps. In particular, the invention is related to shrouds for halogen incandescent lamps.

BACKGROUND OF THE INVENTION

Halogen lamps have become very popular, due in part to their relatively small size and their relatively high lumens with a relatively low wattage. However, the cost of halogen lamps remains high.

U.S. Pat. No. 5,610,469 to Bergman, the entire contents of which are incorporated by reference, discloses an electric lamp with an energy reflecting shroud disposed within a sealed envelope. The shroud is coated with an energy reflecting material, either on an inner or outer surface. The coated shroud comprises a ellipsoidally-shaped reflecting section and cylindrically-shaped end sections for mounting the shroud onto a bulb portion of an arc tube light source. Bergman does not pertain to a halogen incandescent lamp.

U.S. Pat. Nos. 5,221,876 to Bergman and 4,517,491 to Otto, the entire contents of which are incorporated by reference, disclose electric lamp with an energy reflecting shroud. While the shrouds reflect energy, the shrouds of each are not separate from the lamp itself, as they form a part of the lamp. The shrouds are seen to be needed for the complete assembly of the lamps. Further, the shrouds of each are not mounted on the lamp, but are mounted on a support of the lamp.

U.S. Pat. Nos. 4,535,269 to Tschetter, the entire contents of which are incorporated by reference, discloses a lamp with its inner bulb coated with an infrared reflecting shroud. As discussed hereinafter, while the lamp exhibits exceptional characteristics, the fill pressure of the lamp may be limited due to the location of the coating.

The cost of halogen lamps is based on several factors. However, there are at least two dominant factors involved with the pricing of halogen lamps. One of these dominant factors is a unit price of the quartz filament tubes. Another dominant factor in the cost of halogen lamps is the cost of an infrared radiation or light reflecting coating (hereafter "infrared reflecting coating") that is applied to interior surfaces of infrared halogen lamps. The infrared reflecting coating is intended to reflect energy back onto filaments of the lamp to heat the filaments. This heating of the filaments by reflected energy permits a more efficient efficacy, which is of course desirable.

In conventional surface coated infrared halogen lamps, only a portion of the inner surface will reflect energy back onto the filaments. However, the entire surface is coated with an infrared reflecting coating. Other than from a relatively small effective reflective area, coated areas of the tube will not reflect energy from the lamp onto the filaments. The energy from these other areas will merely be reflected to points either outside of the lamp or to parts of the lamp that will not benefit from the reflected energy. This ineffective reflection is an inefficient use of the coating. This waste of coating resources ultimately causes the cost of infrared reflecting halogen lamps to undesirably rise.

Further, conventional surface coated infrared halogen lamps are limited in the total fill pressure they can maintain due to the stress on walls added by the coating. This added stress limits the efficacy and life of such lamps, which is undesirable.

SUMMARY OF THE INVENTION

It is desirable to overcome the above-noted and other deficiencies in known lamp structures.

Therefore, it is desirable to provide a method of providing an infrared reflecting coating on a halogen incandescent lamp, where the infrared reflecting coating is applied only to optically useful regions of a lamp assembly. This method avoids wasting of resources, and will ultimately reduce the price of an infrared reflecting halogen lamp.

Further, it is desirable to provide a halogen incandescent lamp with an infrared reflecting coating on a lamp, where the infrared reflecting coating is applied only to the optically useful regions of the halogen incandescent lamp.

Furthermore, it is desirable to provide a halogen incandescent lamp with an infrared reflecting coating on a lamp, where the infrared reflecting coating is not directly applied and residing on the body on the pressure containing lamp wall. Thus, added fill pressure may be exploited to increase efficacy and life.

Also, it is desirable to provide a method of providing an infrared reflecting coating on a halogen lamp that avoids wasting of resources, and will ultimately reduce the price of a halogen incandescent lamp.

It is desirable to provide a lamp assembly comprises a incandescent lamp capable of generating light. The incandescent lamp comprises a incandescent lamp tube and at least one filament. The assembly also comprises a shroud separate from the halogen incandescent lamp and mounted in communication with the lamp tube on an exterior of the incandescent lamp tube. The shroud comprises a reflecting section disposed about the incandescent lamp tube. The shroud also comprises a coating disposed on the reflecting section of the shroud for reflecting energy having predetermined wavelengths emitted by the incandescent lamp. The reflecting section of the shroud comprises a generally ellipsoidal shape that reflects energy having predetermined wavelengths back substantially toward the incandescent lamp and focusing the reflected energy generally at the at least one filament of the incandescent lamp so as to increase the output from the assembly.

These and other aspects, advantages and salient features of the invention will become apparent from the following detailed description, which, when taken in conjunction with the annexed drawings, disclose preferred embodiments of the invention.

BRIEF DESCRIPTION OF THE DRAWINGS

While the novel features of this invention are set forth in the following description, the invention will now be described from the following detailed description of the invention taken in conjunction with the drawings, in which.

DETAILED DESCRIPTION OF THE INVENTION

Figure 3:
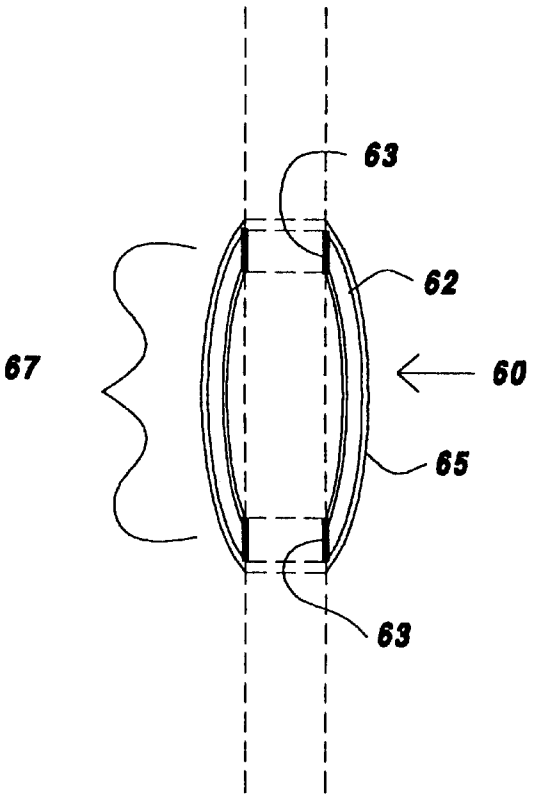
FIG. 3 is a side sectional schematic view of an infrared reflecting shroud, as embodied by the invention.

The invention is directed to a high efficiency low-cost incandescent lamp and energy reflecting shroud. The following description will describe the reflecting shroud as an infrared reflecting shroud, and the incandescent lamp as a halogen incandescent lamp. However, this is merely an example of energy reflecting shrouds, types of energy that can be reflected, and incandescent lamps that within the scope of the invention, as other types of energy can be reflected by appropriate shrouds and other incandescent lamps are within the scope of the invention.

The infrared reflecting shroud, as embodied by the invention, is positioned on an exterior surface of a halogen incandescent lamp tube. The infrared reflecting shroud and halogen incandescent lamp form a robust, optically aligned halogen incandescent lamp. The infrared reflecting shroud may be attached to the lamp to form a one-piece unit. Further, the infrared reflecting shroud may be merely on the lamp, held thereto by friction or simple placement.

As discussed above, in conventional surface coated infrared halogen lamps, only a portion of the surface, which is entirely coated with infrared reflecting material, will reflect energy back onto the filaments. Other than a relatively small effective reflective area, energy reflected from coated areas of the tube of the lamp will not be reflected onto the filaments. The energy from these other areas will merely be reflected to points either outside of the lamp or to parts of the lamp that will not benefit from the reflected energy. This ineffective reflection is an inefficient use of the coating and a waste of energy.

The halogen incandescent lamp with the external shroud, as embodied by the invention, overcomes the deficiencies of conventional surface coated lamps by focusing reflected energy onto filaments of the halogen incandescent lamp. The external shroud is the portion of the halogen incandescent lamp with the external shroud that includes a coating of reflecting material. Accordingly, the power to maintain a constant temperature of filaments of the lamp is reduced. Thus, efficiency and efficacy of the lamp with the external shroud, as embodied by the invention, are increased without additional energy being used to heat the filaments.

The provision of an infrared reflecting shroud on a halogen incandescent lamp, as embodied by the invention, is advantageous in reducing costs of infrared reflecting lamp structures. Previously, it was common for an entire surface of a lamp tube to be coated with an infrared reflecting material. This entire coating is costly and inefficient, since only a portion of the infrared reflecting coating will be positioned at locations where energy will be reflected back onto a filament of the halogen incandescent lamp and some of the coating will be positioned at locations where energy will not even be directed. The remainder of the energy, which is reflected by the infrared coating on the entire inner surface of the halogen incandescent lamp, is wasted, as reflected energy from those portions will not impinge on a filament. Thus, the infrared coating material is virtually wasted at locations other than where it will reflect energy back onto filaments, since it performs no useful function.

Since the cost of infrared coating material and the processes of applying it to surfaces of halogen incandescent lamps is relatively high, coating the surface of a lamp tube, where a majority of it is wasted, is a significant expenditure and waste of resources. An infrared reflecting shroud with the outer surface coated applied to a lamp tube exterior, as embodied by the invention, will provide significant savings. Further, it is believed that a cost of the coated infrared reflecting shroud, as embodied by the invention, will be significantly lower than a cost of coating an entire surface of a halogen incandescent lamp with its entire surface coated with infrared reflecting material.

The infrared reflecting shroud with its surface coated on a halogen incandescent lamp, as embodied by the invention, will also enhance the performance of the halogen incandescent lamp. Whereas, the efficiency of the infrared reflecting shroud provided halogen incandescent lamp will increase due to the reflection of energy back onto the at least one filament of the lamp, the efficacy of the halogen incandescent lamp, as embodied by the invention will increase. As embodied by the invention, the efficacy of the halogen incandescent lamp will be increased.

Further, the halogen incandescent lamp with an external infrared reflecting shroud, as embodied by the invention, is able to have a higher internal pressure, compared to a lamp with its tube's surface coated with an infrared reflecting coating. The increased pressure is due, at least in part, to the absence of the coating on the tube itself, in the halogen incandescent lamp with an external infrared reflecting shroud. In conventional lamps with infrared reflecting coating applied to a surface of a lamp, the coating inherently creates stresses on the surface on which it is applied. Thus, internal pressure of the lamp must be limited, in order to avoid failure caused by the added stress due to the reflecting coating on the surface of the lamp.

As embodied by the invention, the infrared reflecting coating is applied to the external shroud. The reflecting coating is thus exterior to the lamp tube. The pressure in a halogen incandescent lamp can be increased above conventional internal surface coated lamps. This increase of pressure in halogen incandescent lamp provided with an external shroud can be achieved without concerns of failure due to stresses induced by the coating on a lamp, and can lead to a further increase in lamp efficacy and life, as is well known in the art.

The infrared reflecting shroud, as embodied by the invention, is designed to have a geometry and curvature so as to focus reflected energy back onto the filament or filaments. This focused reflection in turn leads to an increased output from the halogen incandescent lamp. Accordingly, the infrared reflecting shroud comprises a geometry that conforms to the shape of the filament, to effectively and efficiently reflect the desired energy back onto the filaments.

The infrared reflecting shroud provides a significant improvement in the amount of reflected energy that is returned to the filaments. For example, but in no way limiting of the invention, about 90 percent of the emitted infrared radiation is reflected back to the filament when foci of the infrared reflecting shroud are appropriately positioned. Preferably, at least 50 percent of the emitted infrared radiation is reflected back to the filament, more preferably at least 60 percent of the emitted infrared radiation, even more preferably at least 70 percent of the emitted infrared radiation, even more preferably 80 percent of the emitted infrared radiation, and most preferably at least 95 percent of the emitted infrared radiation.

The reflecting portion of the infrared reflecting shroud is sized and shaped such that of the emitted infrared radiation emitted by the halogen incandescent lamp and reflected by the infrared reflecting shroud is substantially reflected back toward the filament and focused on the filament or filaments of the lamp. The size and shape of the infrared reflecting shroud is preferably tailored to maximize the reflection of the desired radiation.

The reflecting coating is disposed on an outer surface of the infrared reflecting shroud for selectively reflecting and transmitting various portions of the electromagnetic spectrum. The reflecting coating comprises an appropriate energy reflecting coating, that is generally transparent to visible radiation but reflects some of at least one of ultraviolet and infrared radiation. Therefore, less electrical power is needed to maintain the temperature of the filaments. Therefore, the reflected energy will increase the efficacy of the light source without added electrical power.

The reflective coating, as embodied by the invention, can comprise an optical interference filter made of alternating layers of refractory metal oxides having high and low indices of refraction, such coatings being known in the art. Refractory metal oxides are used because they are able to withstand relatively high temperatures. Such oxides include, for example, titania, hafnia, tantala, and niobia for the high index of refraction material and silica or magnesium fluoride for the low index of refraction material. Materials with an intermediate index of refraction, such as but not limited to, silicon nitride and aluminum oxide may be used either for the high or low index material.

A desirable property of an optical interference filter is that it reflects energy of a particular wavelength such as infrared light. This reflection is accomplished by selecting layer thicknesses and layer count for a given set of high and low index of refraction materials, as is known in the art. A preferred coating is formed by depositing alternating layers of tantala and silica by any well known deposition process.

Further, as embodied by the invention, it will be noted that other types of reflective coatings, known in the art are within the scope of the invention. For example, an ultraviolet reflecting coating on the infrared reflecting shroud is within the scope of the invention.

Figure 1:
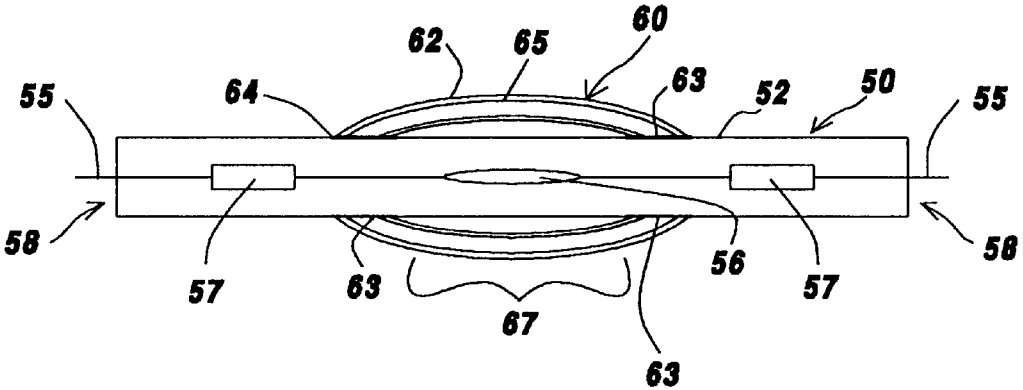
FIG. 1 is a side schematic view of a halogen incandescent lamp and an infrared reflecting shroud, as embodied by the invention.

FIG. 1 is an illustration of an incandescent lamp 50, for example a halogen incandescent lamp 50, provided with an exterior shroud 60. As embodied by the invention, the halogen incandescent lamp 50 is illustrated as a double ended halogen incandescent lamp, and the shroud is provided with an infrared reflecting coating 62 on its outer surface. However, this is merely exemplary of the incandescent lamps within the scope of the invention.

The reflecting coating, as embodied by the invention, can be applied to the outer surface as described herein. Further, the reflecting coating can be applied to an inner surface of the shroud, alone or in addition to the outer surface.

In FIG. 1, the halogen incandescent lamp 50 is formed with a generally cylindrical lamp tube 52. The lamp tube 52 can be formed of any appropriate tube material, such as but not limited to glass, quartz and other such materials. The lamp tube 52 is double ended, with terminals 55 extending from ends of at least one filament 56 through ends 58 of the lamp tube 52.

The lamp tube 52 is filled with a gas, as is known in the art, and sealed at seals 57. The seals 57 comprise an appropriate seal structure to maintain the gas within the halogen incandescent lamp 50, such as but not limited to molybdenum foil pinch seals. Further, the seals 57 maintain and position the filament 56 of the halogen incandescent lamp 50 at approximately a midpoint of the lamp tube 52 spaced from the walls of the lamp tube 52.

The shroud 60, as embodied by the invention, is provided on a halogen incandescent lamp 50. The infrared reflecting shroud 60 comprises an infrared reflecting coating 62, which is located on an outer surface 65 of the shroud 60. The inner surface of the shroud 60 is positioned, as described hereinafter, so as to surround the filament (only one filament is illustrated) of the halogen incandescent lamp 50, so as to reflect energy back at the filament.

Figure 6:
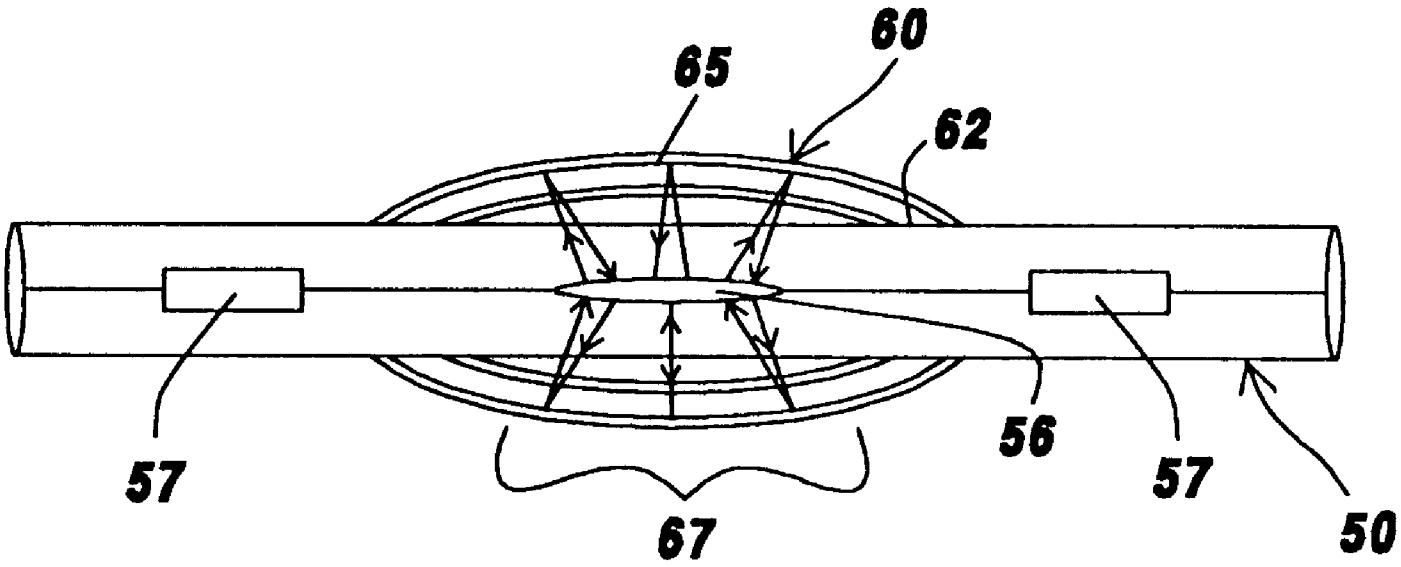
FIG. 6 is a side schematic view of a halogen incandescent lamp and an infrared reflecting shroud, as embodied by the invention, further illustrating reflection of energy.

The infrared reflecting shroud 60 is positioned on a lamp tube 52 of the halogen incandescent lamp 50 at a predetermined location. The infrared reflecting shroud 60 has a predetermined geometry and configuration, which is based on the configuration of the halogen incandescent lamp 50, so when positioned at the predetermined location effectively and efficiently reflects and focuses infrared energy back onto filaments 56 of the halogen incandescent lamp 50. FIG. 6 illustrates the reflection of energy waves focused back on a filament 56, as embodied by the invention.

The shroud 60 is positioned on the lamp tube 52 at an appropriate location to reflect and focus energy back onto the at least one filament 56, as illustrated in FIG. 6. The shroud 60 is positioned on the lamp tube 52 by approximately centering the shroud 60 with respect to the at least one filament 56. The positioning of the shroud 60 centered with respect to the at least one filament 56, focuses reflected energy back onto the onto the at least one filament 56. This illustrated reflection of energy back onto the at least one filament 56 heats the at least one filament 56. Thus, due to the optimal reflection of energy onto the at least one filament 56, the at least one filament is heated more efficiently with less electrical power than if the at least one filament 56 was heated by current passing through the terminals 55 alone. Therefore, with the increased heating of the at least one filament 56 with the same input of energy through the terminals 55, the at least one filament 56 of the halogen incandescent lamp 50 is more energy and light efficient.

As illustrated in FIG. 1, the infrared reflecting coated shroud 60 covers only portions of the lamp tube 52 of the halogen incandescent lamp 50. The infrared reflecting shroud 60 covers only portions of the lamp tube 52 where reflected infrared energy is efficiently reflected back onto filaments 56 of the halogen incandescent lamp 50. Thus, the infrared reflecting shroud 60 and lamp tube 52 of the halogen incandescent lamp 50 form a robust, optically aligned halogen infrared reflecting lamp 200.

Figure 2:
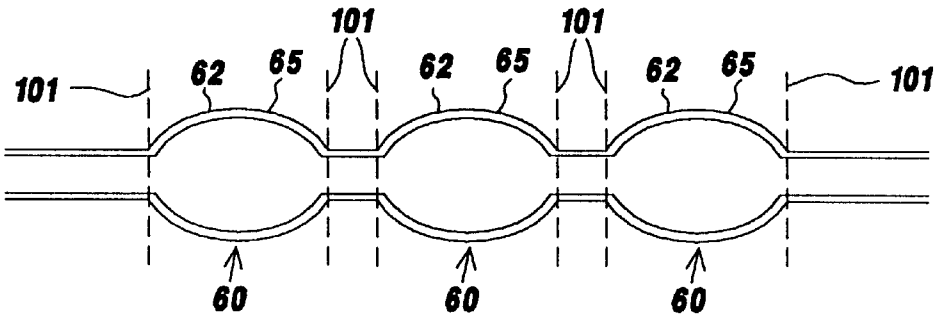
FIG. 2 is a side sectional view of a blank used to make an infrared reflecting shroud as embodied by the invention.

The infrared reflecting shroud 60 of the robust, optically aligned halogen incandescent lamp 200, as embodied by the invention, comprises an optically reflecting elliptically shaped element. However as discussed above, the shape and geometry of the infrared reflecting shroud generally conforms to the shape of the filament or filaments of the lamp. Accordingly, the elliptical shape in FIGS. 1–3 is merely exemplary of the numerous shapes that the infrared reflecting shroud can comprise.

Figure 9:
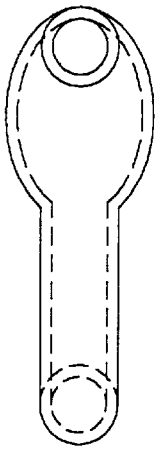
FIG. 9 is a side part sectional schematic view of yet another infrared reflecting shroud, as embodied by the invention.
Figure 8:
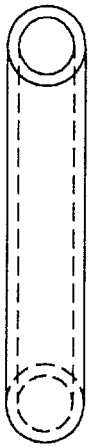
FIG. 8 is a side part sectional schematic view of another infrared reflecting shroud, as embodied by the invention.
Figure 7:
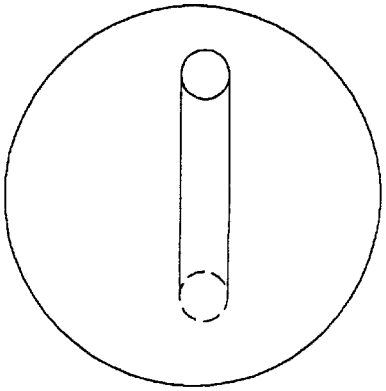
FIG. 7 is a side part sectional schematic view of an infrared reflecting shroud, as embodied by the invention.
Figure 11:
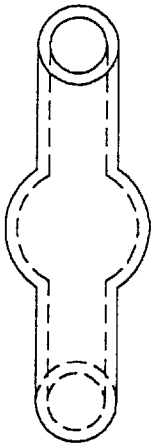
FIG. 11 is a side part sectional schematic view of an infrared reflecting shroud, as embodied by the invention.
Figure 10:
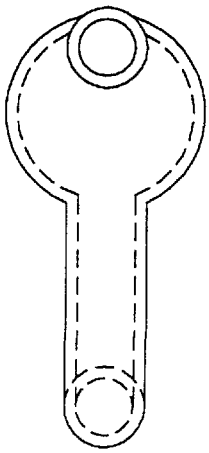
FIG. 10 is a side part sectional schematic view of a further infrared reflecting shroud, as embodied by the invention.

For example FIGS. 7–11 illustrate other of the numerous possible shapes for an infrared reflecting shroud. FIG. 7 is a side part sectional schematic view of an infrared reflecting shroud that is generally spherical. FIG. 8 is a side part sectional schematic view of infrared reflecting shroud, as embodied by the invention, that is generally cylindrical. FIG. 9 is a side part sectional schematic view of an infrared reflecting shroud, as embodied by the invention, that is part cylindrical and part elliptical. FIG. 10 is a side part sectional schematic view of an infrared reflecting shroud, as embodied by the invention, that is part cylindrical and part spherical. FIG. 11 is a side part sectional schematic view of an infrared reflecting shroud, as embodied by the invention, that is part cylindrical, part spherical and part cylindrical. Again, these infrared reflecting shrouds illustrated in the figures are merely exemplary of the infrared reflecting shrouds that comprise a geometry that conforms to the geometry of the filament or filaments of the lamp, such as but not limited to parabolic if there are a plurality of filaments, combinations of geometries and any other focusing geometry.

The infrared reflecting shroud 60 can be formed from an appropriate material, such as one selected from glass and quartz. Glass was not commonly used with reflective coatings since the pressure applied thereto would need to be relatively small to avoid failure. However, with the reflective coating on the exterior shroud, the pressure in a lamp tube can be increased without failure as before.

The infrared reflecting shroud 60 is coated at outer surfaces 65 with an appropriate reflecting material coating 62 at predetermined reflective areas of the lamp tube 52. The infrared material coating 62 comprises any appropriate infrared reflecting material, such as but not limited to, at least one of a tantalam/silica multi-layer dielectric filter. However other combinations of dielectrics are within the scope of the invention. As embodied by the invention, the infrared reflecting material 62 comprises at least one of titania/silica, zinc oxide/silica, zirconia/silica, silicon nitride/silica, and titania/magnesium fluoride.

Further, the infrared reflecting material 62 can comprise at least one of a metal and metal dielectric mirror. These mirrors comprises very thin layers of silver between at least one of silica and titania layers. The infrared reflecting material 62 also can comprise a Drude mirror, which comprises conducting oxides, such as but not limited to indium doped tin oxide and antimony doped tin oxide, and relies upon the spectral properties of the conducting oxides. The conducting oxides are often sandwiched between dielectric layers, but need not be so sandwiched.

As seen in the figures, the essentially elliptically shaped infrared reflecting shroud 60 comprises a continuous elliptically curved outer surface 65. The outer surface 65 of the essentially elliptically shaped infrared reflecting shroud 60 comprises a generally concave inner surface, where the outer surface 65 is coated with the infrared reflecting coating 62, as described hereinafter.

The essentially elliptically shaped infrared reflecting shroud 60 further comprises open ends 63 with a continuous mid-section 67. The open ends 63 are generally circular in shape to conform with a generally cylindrical shape of the lamp tube 52 of halogen incandescent lamp 50, at locations where the infrared reflecting shroud 60 and halogen incandescent lamp 50 are proximate one another.

The open ends 63 of the infrared reflecting shroud 60 are preferably of the same diameter since the cylindrical lamp tube 52 of the halogen incandescent lamp 50 has a generally constant diameter. Thus, the open ends 63 conform with the outer diameter of the lamp tube 52 of the halogen incandescent lamp 50. As seen in FIG. 3, the open ends 63 of the infrared reflecting shroud 60 are generally axially aligned with each to conform with a similar outer profile of the halogen incandescent lamp 50. Accordingly, this diameter and axial conformation permit infrared reflecting shroud 60 and lamp tube 53 of the halogen incandescent lamp 50, as embodied by the invention, to be mated and in cooperation, as described hereinafter.

As embodied by the invention, the infrared reflecting shroud 60 is proximate to and can be attached to the lamp tube 52 of the halogen incandescent lamp 50. The infrared reflecting shroud 60 may be sealed to the lamp tube 52, for example by welding or otherwise sealing the shroud to the lamp tube. Glass frit, a bead of glass or extra glass 64 may be used to connect the shroud 60 to the lamp tube 52. Alternately, the infrared reflecting shroud 60 need not be sealed to the lamp tube 52, but merely in close conforming arrangement with the lamp tube 52 of the halogen incandescent lamp 50.

In the robust, optically aligned halogen infrared reflecting lamp 200, the seals 57 are preferably positioned outside of the focal range of the shroud 60. Thus, reflected energy is maintained away from the seals 57. The seals 57 are not heated up past a predetermined temperature, and subsequently do not degenerate the seals 57, and possibly cause a failure at the seals. Accordingly, a sound seal of the robust, optically aligned halogen infrared reflecting lamp 200 is maintained at the seals 57.

As embodied by the invention, a further exterior infrared reflecting shroud is provided on an incandescent lamp, for example a halogen incandescent lamp. As illustrated in the FIGS. 4 and 5, the infrared reflecting shroud 10, as embodied by the invention, comprises an infrared reflecting coating 12, which is located on an outer surface of the shroud. The inner surface of the shroud is positioned, as described hereinafter, so as to surround filaments 6 of a halogen incandescent lamp 1.

The infrared reflecting shroud 10 is positioned on a tube 2 of a halogen incandescent lamp 1 at a predetermined location. The infrared reflecting shroud 10 effectively and efficiently reflects and focuses infrared energy back onto the filaments 6 of the halogen incandescent lamp 1, as described above. Therefore, a detailed description of the reflection and its effects is not repeated here.

As illustrated, the infrared reflecting coated shroud 10 covers only portions of the halogen incandescent lamp 1, where reflected infrared energy is efficient and desired. Thus, the infrared reflecting shroud 10 and tube 2 of the halogen incandescent lamp 1 form a robust, optically aligned halogen infrared reflecting lamp 100.

As embodied by the invention, a low cost halogen incandescent lamp 1 is provided as a light source. The halogen incandescent lamp 1 comprises a conventional single ended halogen incandescent light, as known in the art. The halogen incandescent lamp 1 comprises a lamp tube 2, otherwise known as a filament tube.

Figure 4:
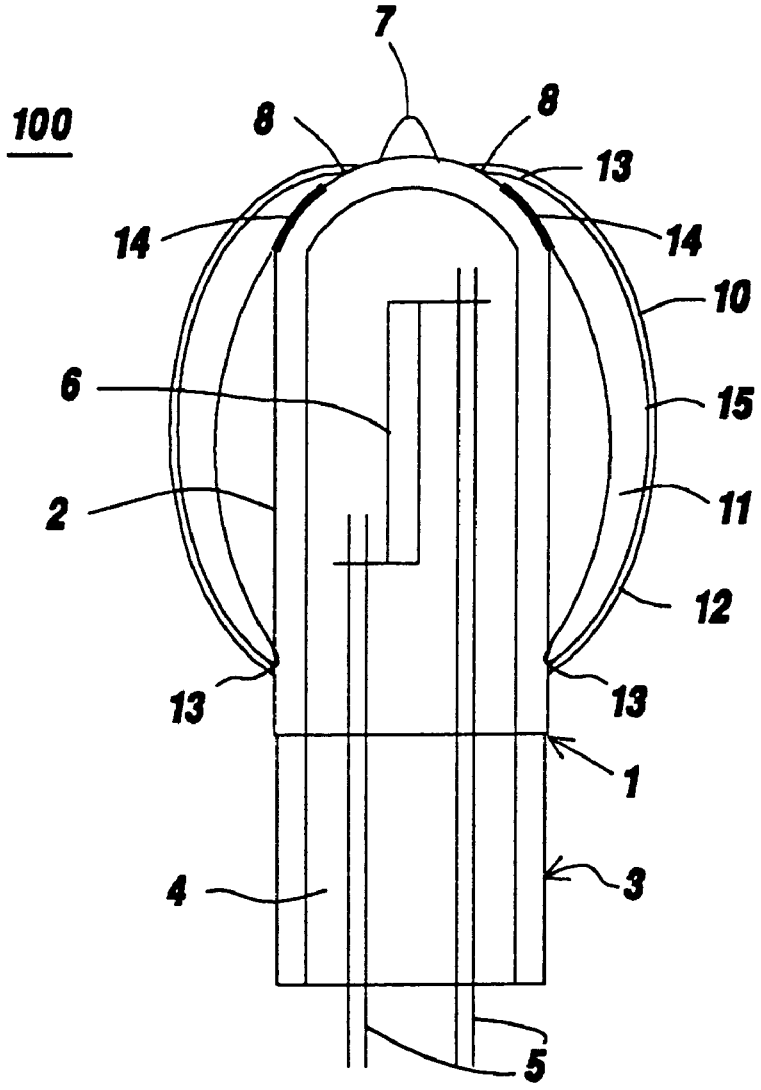
FIG. 4 is a side sectional schematic view of a further halogen incandescent lamp and an infrared reflecting shroud, as embodied by the invention.

In FIG. 4, the lamp tube 2 fits onto and is sealingly connected to a filament holder 3. The filament holder 3 comprises a base 4 that supports at least two terminals 5 and at least one filament 6. Whereas, terminals 5, filament holders 3, lamp tubes 2, and manners for connection therebetween are well known in the art, a further description of this feature of the invention will not be discussed. As is also known in the art, the lamp tube 2 and the filament holder 3 of the halogen incandescent lamp 1 may be formed as a single element. The details of the lamp tube 2 and filament holder 3 are known, and a further description will not be provided.

Figure 5:
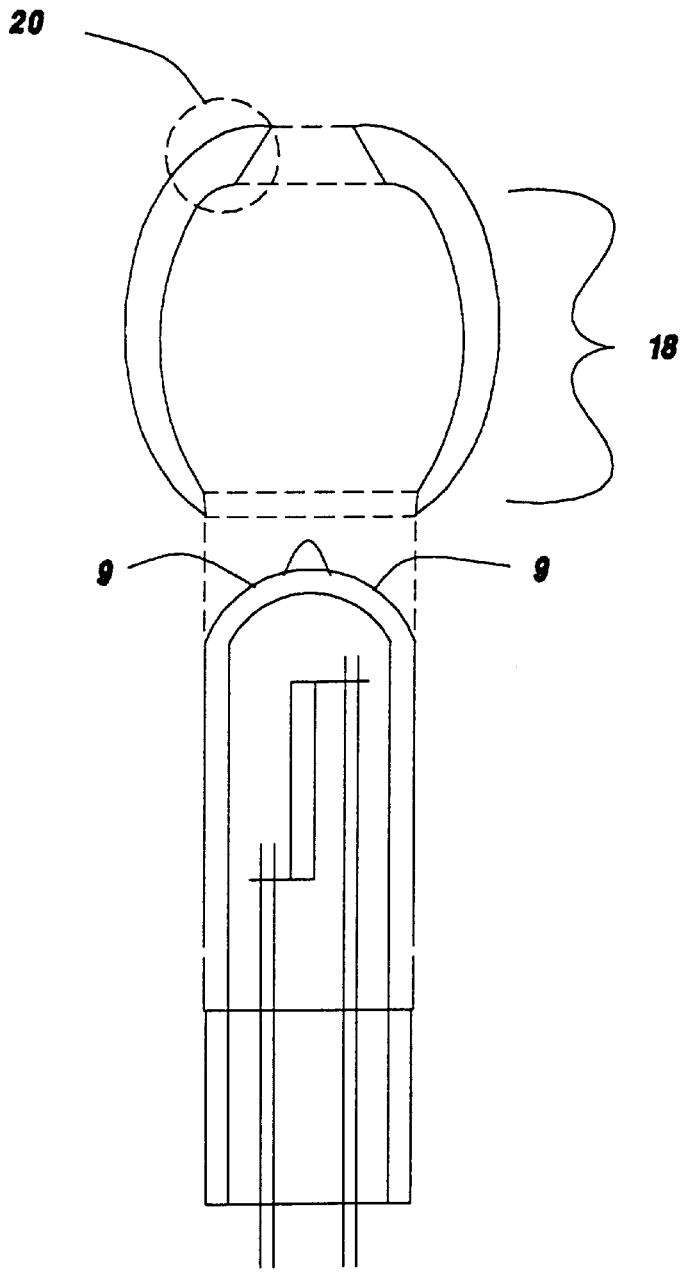
FIG. 5 is a side sectional schematic exploded view of a halogen incandescent lamp and infrared reflecting shroud, as embodied by the invention.

The lamp tube 2 of the halogen incandescent lamp 1 comprises a fill tip 7, which as illustrated, is opposite the terminals 5 and filament holder 3 of the halogen incandescent lamp 1. The lamp tube 2 of the halogen incandescent lamp 1 is essentially a cylindrically shaped structure with a generally constant diameter over a length of the tube of the halogen incandescent lamp 1. The fill tip 7 of the halogen incandescent lamp 1 narrows from an upper end of the lamp tube 2 to a closed off end portion 8. The closed off end portion may form a point, as illustrated in FIGS. 4 and 5. Further, the fill tip 7 may be formed with a smooth convex outer surface.

The closed off end portion 8 comprises a tapering configuration from the upper end section of the lamp tube 2 to an apex or fill tip 7 of the closed off end section 8. The tapering configuration of the closed off end section 8 provides a joining surface 9 (FIG. 5) where the infrared reflecting shroud 10 is attached to the lamp tube 2 of the halogen incandescent lamp 1. The joining surface 9 of the closed off end section 8 provides a relatively contiguous surface to assure a sound bonding of the infrared reflecting shroud 10 thereto. However, depending on the method of bonding the infrared reflecting shroud 10 to the lamp tube 2 of the halogen incandescent lamp 1, the surface may be irregularly shaped, as long as the method to attach the infrared reflecting shroud 10 to the lamp tube 2 provides a physically secure attachment.

The infrared reflecting shroud 10 of the robust, optically aligned halogen incandescent lamp 100, as embodied by the invention, comprises an optically reflecting elliptically shaped element. The infrared reflecting shroud 10 can be formed from any appropriate material, for example a material selected from at least one of glass and quartz. The infrared reflecting shroud 10 is coated with an appropriate reflecting material coating 12 at appropriate reflective areas of the lamp tube 2, to effectively and efficiently reflect energy back onto the at least one filament of the halogen incandescent lamp 1.

The infrared reflecting shroud 10 comprises an essentially elliptically shaped shroud. As seen in FIGS. 3 and 4, the essentially elliptically shaped infrared reflecting shroud 10 comprises a continuous convexly curved outer surface. The essentially elliptically shaped infrared reflecting shroud 10 comprises a generally concave outer surface 15, where the outer surface 15 is coated with an infrared reflecting coating 12, as described.

The essentially elliptically shaped infrared reflecting shroud 10 comprises open ends 13 with a continuous mid-section 18 (FIG. 5). The open ends 13 comprise a generally circular periphery to conform with a shape of the lamp tube 2 of the halogen incandescent lamp 1, at locations where the shroud and lamp are to be joined. The open ends 13 of the infrared reflecting shroud 10 may be of the same diameter, or of differing diameters, in order to conform with the outer diameter of the lamp tube 2 of the halogen incandescent lamp 1. Further, as best seen in FIG. 5, an open end 13 of the infrared reflecting shroud 10 may have an arcuate tapered configuration 20, in order to conform with a similarly tapering arcuate profile at the closed off end section 8 providing the joining surface 9 of the halogen incandescent lamp 1. This conformation permits the infrared reflecting shroud 10 and lamp tube 2 of the halogen incandescent lamp 1, as embodied by the invention, to be mated and connected, as described hereinafter.

As embodied by the invention, the infrared reflecting shroud 10 is attached to the lamp tube 2 of the halogen incandescent lamp 1. The infrared reflecting shroud 10 may be sealed to the lamp tube, for example by welding or otherwise sealing the infrared reflecting shroud 10 to the lamp tube 2. Glass frit, a bead of glass or extra glass 14 may be used to connect the infrared reflecting shroud 10 to the lamp tube 2. Alternately, the infrared reflecting shroud 10 need not be sealed to the lamp tube 2, but merely in close conforming arrangement with the lamp tube 2.

As discussed above, the outer surface of the infrared reflecting shroud 10 is coated with an appropriate infrared reflecting coating material 12. The infrared coating material 12 may be an appropriate infrared reflecting material, such as but not limited to, at least one of a tantalam/silica multi-layer dielectric filter. However other combinations of dielectrics are within the scope of the invention. As embodied by the invention, the infrared reflecting material 12 comprises at least one of titania/silica, zinc oxide/silica, zirconia/silica, silicon nitride/silica, and titania/magnesium fluoride.

Further, the infrared reflecting material 12 comprises at least one of a metal and metal dielectric mirror. These mirrors comprises very thin layers of silver between at least one of silica and titania layers. The infrared reflecting material 12 also may comprise a Drude mirror, which comprises conducting oxides, such as but not limited to indium doped tin oxide and antimony doped tin oxide, and relies upon the spectral properties of the conducting oxides. The conducting oxides are often sandwiched between dielectric layers, but need not be so sandwiched.

The infrared reflecting shroud 10 is positioned on the lamp tube 2 at an appropriate location to reflect and focus energy back onto the at least one filament 6. This reflection and focusing of energy back onto the at least one filament heats the at least one filament. The infrared reflecting shroud 10 is positioned on the lamp tube by centering the infrared reflecting shroud 10 with respect to the at least one filament 6. The positioning of the infrared reflecting shroud 10 centered with respect to the at least one filament 6, focuses reflected energy back onto the onto the filament 6. Thus, an optimal reflection of energy onto the at least one filament 6 is obtained.

Whereas, the amount of energy output from a filament 6 is related to the energy input into the at least one filament 6 and the temperature of the at least one filament 6, the reflection of energy back onto the at least one filament 6 will heat the at least one filament 6 up more efficiently compared to a halogen incandescent lamp 1 without any focused reflected energy. Thus, this optimal reflection results in an optimized optical effect, by heating the at least one filament 6 and permitting an increased energy output from the at least one filament 6 of the halogen incandescent lamp 1 with a same amount of energy into the halogen incandescent lamp 1.

Further, with either of the shrouds disclosed above and those within the scope of the invention, the shroud comprises a shape that conforms with the shape of filaments of the lamp to comprise a generally focusing geometry.

While the embodiments described herein are preferred, it will be appreciated from the specification that various combinations of elements, variations or improvements therein may be made by those skilled in the art are within the scope of the invention.

What is claimed is:

1. An lamp assembly comprising:

a incandescent lamp capable of generating light, the incandescent lamp comprising a incandescent lamp tube and at least one filament;

a shroud separate from the incandescent lamp and mounted in communication with the lamp tube on an exterior of the incandescent lamp tube, the shroud comprising a reflecting section disposed about the incandescent lamp tube; and an energy reflecting coating disposed on the reflecting section of the shroud for reflecting energy having predetermined wavelengths emitted by the incandescent lamp; and wherein the reflecting section of the shroud comprises a focusing geometrical shape that reflects energy having predetermined wavelengths back substantially toward the incandescent lamp and focusing the reflected energy generally at the at least one filament of the incandescent lamp.

2. The assembly according to claim 1, wherein the incandescent lamp comprises a double ended incandescent lamp, and the incandescent lamp tube comprises a generally cylindrical incandescent lamp tube.

3. The assembly according to claim 1, wherein the shroud comprises open ends, the open ends capable of receiving the incandescent lamp tube of the incandescent lamp.

4. The assembly according to claim 3, wherein the incandescent lamp comprises a double ended incandescent lamp, the incandescent lamp tube comprises a generally cylindrical lamp tube, and the open ends of the shroud comprising substantially equal diameters so as to position the generally cylindrical lamp tube of the double ended incandescent lamp extending through the open ends.

5. The assembly according to claim 3, the incandescent lamp comprises a single ended incandescent lamp tube, a filament holder connected to the single ended lamp tube to form the incandescent lamp, the incandescent lamp tube comprising a generally cylindrical portion extending from the filament holder and tapering to a closed end portion opposed to the filament holder, wherein the open ends of the shroud comprise open ends of differing diameters, a first end of the shroud comprising a first diameter positioning the generally cylindrical portion of the incandescent lamp tube, and a second end of the shroud comprising a second diameter to position the closed end portion of the incandescent lamp tube.

6. The assembly according to claim 5, wherein the second end of the shroud comprises an arcuate surface.

7. The assembly according to claim 1, wherein the energy reflecting coating reflects a portion of radiation emitted by the incandescent lamp.

8. The assembly according to claim 1, wherein the coating comprises an optical interference filter, the filter comprising alternating layers of tantala and silica.

9. The assembly according to claim 1, wherein the coating reflects infrared radiation emitted by the lamp, thus heating the at least one filament.

10. The assembly according to claim 1, the reflecting section of the shroud comprising foci effective for reflecting energy having predetermined wavelengths substantially back toward and focusing reflected energy on the at least one filament of the incandescent lamp.

11. The assembly according to claim 10, wherein the shroud comprises a material selected from the group consisting of quartz and glass.

12. The assembly according to claim 1, the shroud comprising an essentially ellipsoidal shape, the essentially ellipsoidally shape being uniform such that if two halves of the ellipsoidal shape are defined by a plane in a middle of the shroud, the plane being perpendicular to an axis, the two halves will be mirror images of one another.

13. The assembly according to claim 1, the incandescent lamp tube comprises a material selected from the group consisting of glass and quartz.

14. The assembly according to claim 1, the shroud comprises a material selected from the group consisting of glass and quartz.

15. The assembly according to claim 1, the coating comprising an infrared reflecting material selected from the group consisting of at least one of, a titania/silica, zinc oxide/silica, zirconia/silica, silicon nitride/silica, and titania/magnesium fluoride.

16. The assembly according to claim 1, the coating comprising a tantalam/silica multi-layer dielectric filter.

17. The assembly according to claim 1, the shroud being fit non-sealingly onto the incandescent lamp tube.

18. The assembly according to claim 1, the shroud being sealingly fit onto the incandescent lamp tube.

19. The assembly according to claim 1, wherein the incandescent lamp comprises halogen incandescent lamp.

20. The assembly according to claim 19, the halogen incandescent lamp comprises a double ended halogen incandescent lamp, and the halogen incandescent lamp tube comprises a generally cylindrical halogen incandescent lamp tube.

21. The assembly according to claim 19, wherein the shroud comprises open ends, the open ends capable of receiving the halogen incandescent lamp tube of the halogen incandescent lamp.

22. The assembly according to claim 19, wherein the halogen incandescent lamp comprises a double ended halogen incandescent lamp, the halogen incandescent lamp tube comprises a generally cylindrical lamp tube, and the open ends of the shroud comprising substantially equal diameters so as to position the generally cylindrical lamp tube of the double ended halogen incandescent lamp extending through the open ends.

23. The assembly according to claim 19, the halogen incandescent lamp comprises a single ended halogen incandescent lamp tube, a filament holder connected to the single ended lamp tube to form the halogen incandescent lamp, the halogen incandescent lamp tube comprising a generally cylindrical portion extending from the filament holder and tapering to a closed end portion opposed to the filament holder, wherein the open ends of the shroud comprise open ends of differing diameters, a first end of the shroud comprising a first diameter positioning the generally cylindrical portion of the halogen incandescent lamp tube, and a second end of the shroud comprising a second diameter to position the closed end portion of the halogen incandescent lamp tube.

24. The assembly according to claim 23, wherein the second end of the shroud comprises an arcuate surface.

25. The assembly according to claim 19, wherein the energy reflecting coating reflects a portion of radiation emitted by the halogen incandescent lamp.

26. The assembly according to claim 19, wherein the coating comprises an optical interference filter, the filter comprising alternating layers of tantala and silica.

27. The assembly according to claim 19, wherein the coating reflects infrared radiation emitted by the lamp, thus heating the at least one filament.

28. The assembly according to claim 19, the reflecting section of the shroud comprising foci effective for reflecting energy having predetermined wavelengths substantially back toward and focusing reflected energy on the at least one filament of the halogen incandescent lamp.

29. The assembly according to claim 28, wherein the shroud comprises a material selected from the group consisting of quartz and glass.

30. The assembly according to claim 19, the shroud comprising an essentially ellipsoidal shape, the essentially ellipsoidally shape being uniform such that if two halves of the ellipsoidal shape are defined by a plane in a middle of the shroud, the plane being perpendicular to an axis, the two halves will be mirror images of one another.

31. The assembly according to claim 19, the halogen incandescent lamp tube comprises a material selected from the group consisting of glass and quartz.

32. The assembly according to claim 19, the shroud comprises a material selected from the group consisting of glass and quartz.

33. The assembly according to claim 19, the coating comprising an infrared reflecting material selected from the group consisting of at least one of, a titania/silica, zinc oxide/silica, zirconia/silica, silicon nitride/silica, and titania/magnesium fluoride.

34. The assembly according to claim 19, the coating comprising a tantalam/silica multi-layer dielectric filter.

35. The assembly according to claim 19, the shroud being fit non-sealingly onto the halogen incandescent lamp tube.

36. The assembly according to claim 19, the shroud being sealingly fit onto the halogen incandescent lamp tube.

37. The assembly according to claim 1, wherein the shroud comprises a generally spherical infrared reflecting shroud.

38. The assembly according to claim 1, wherein the shroud comprises a generally cylindrical infrared reflecting shroud.

39. The assembly according to claim 1, wherein the shroud comprises a generally part cylindrical and part elliptical infrared reflecting shroud.

40. The assembly according to claim 1, wherein the shroud comprises a generally part cylindrical and part spherical infrared reflecting shroud.

41. The assembly according to claim 1, wherein the shroud comprises a general geometry conforming to the general geometry of the at least one filament of the incandescent lamp.

42. The assembly according to claim 19, wherein the shroud comprises a generally spherical infrared reflecting shroud.

43. The assembly according to claim 19, wherein the shroud comprises a generally cylindrical infrared reflecting shroud.

44. The assembly according to claim 19, wherein the shroud comprises a generally part cylindrical and part elliptical infrared reflecting shroud.

45. The assembly according to claim 19, wherein the shroud comprises a generally part cylindrical and part spherical infrared reflecting shroud.

46. The assembly according to claim 19, wherein the shroud comprises a general geometry conforming to the general geometry of the at least one filament of the incandescent lamp.

* * * * *